US008209877B2

(12) United States Patent
Smal

(10) Patent No.: US 8,209,877 B2
(45) Date of Patent: Jul. 3, 2012

(54) HAIR STRAIGHTENING DEVICE

(75) Inventor: Olivier Smal, Magnee (BE)

(73) Assignee: Faco S.A., Wandre (BE)

( * ) Notice: Subject to any disclaimer, the term of this patent is extended or adjusted under 35 U.S.C. 154(b) by 21 days.

(21) Appl. No.: 12/299,151

(22) PCT Filed: Sep. 29, 2006

(86) PCT No.: PCT/BE2006/000107
§ 371 (c)(1),
(2), (4) Date: Oct. 31, 2008

(87) PCT Pub. No.: WO2007/134408
PCT Pub. Date: Nov. 29, 2007

(65) Prior Publication Data

US 2009/0199864 A1 Aug. 13, 2009

(30) Foreign Application Priority Data

May 18, 2006 (EP) ..... 06447066

(51) Int. Cl.
*A45D 20/12* (2006.01)

(52) U.S. Cl. ..... 34/96; 34/98; 34/99

(58) Field of Classification Search ..... 34/96, 97, 34/98, 99, 101; 132/212, 219, 113, 116, 132/123, 124, 129, 136, 137, 138, 142; 392/379–385; 219/222
See application file for complete search history.

(56) References Cited

U.S. PATENT DOCUMENTS

| | | | | | |
|---|---|---|---|---|---|
| 670,894 | A | | 3/1901 | Emery | |
| 1,197,264 | A | | 9/1916 | Cobb | |
| 1,481,738 | A | * | 1/1924 | Phillips | 132/117 |
| 1,861,040 | A | * | 5/1932 | Williams | 132/118 |
| 2,031,837 | A | * | 2/1936 | Kollsman | 73/386 |
| 3,840,030 | A | * | 10/1974 | Baker | 132/118 |
| 3,850,180 | A | * | 11/1974 | Ryckman et al. | 132/112 |
| 3,850,181 | A | * | 11/1974 | Baker | 132/119.1 |
| 4,198,558 | A | * | 4/1980 | Benty | 34/97 |
| 4,694,528 | A | * | 9/1987 | Comer et al. | 15/330 |

(Continued)

FOREIGN PATENT DOCUMENTS

FR 2674733 A1 * 10/1992

(Continued)

*Primary Examiner* — Jiping Lu
(74) *Attorney, Agent, or Firm* — Reinhart Boerner Van Deuren P.C.

(57) ABSTRACT

The present invention relates to a hair straightening device to be placed on an air blower, comprising a first straightening element and a second straightening element positioned on either side of an air diffuser (9), each of the two elements comprising an outer comb (1) and an inner comb (2), removably attached so as to allow a sliding movement of one relative to the other, said sliding movement of the two outer (1) or inner (2) combs allowing to grip the hair and to stretch it above the air diffuser (9), the teeth of the outer combs (1) being formed by a succession of arches (3) whose holes define two tunnels (4) that make space for the inner combs (2) in such a way as to allow an arrangement of said inner combs (2) beneath said outer combs (1) within said tunnels (4) and to allow said sliding movement of the inner combs (2) relative to the outer combs (1) in order to displace the teeth (5) of said inner combs (2) relative to the planes formed by the arches (3) of the outer combs (1).

6 Claims, 9 Drawing Sheets

U.S. PATENT DOCUMENTS

| | | | | |
|---|---|---|---|---|
| 5,084,973 | A * | 2/1992 | Geer | 30/133 |
| 6,792,692 | B1 * | 9/2004 | Takizawa et al. | 34/96 |
| 6,964,543 | B2 * | 11/2005 | Gerber | 406/14 |
| 2004/0261812 | A1 * | 12/2004 | Csavas | 132/271 |

FOREIGN PATENT DOCUMENTS

| | | | |
|---|---|---|---|
| JP | 09234108 | A * | 9/1997 |
| WO | WO 03/026457 | A1 | 4/2003 |
| WO | WO 03/030675 | A1 | 4/2003 |

* cited by examiner

Section AA'

Central Section

Section CC'

Central Section

Section BB'

Central Section

HAIR STRAIGHTENING DEVICE

CROSS-REFERENCE TO RELATED PATENT APPLICATIONS

This patent application is the National Stage of International Application No. PCT/BE2006/000107, filed Sep. 29, 2006, that claims the benefit of European Application No. 06447066.9, filed May 18, 2006, the entire teachings and disclosure of which are incorporated herein by reference thereto.

FIELD OF THE INVENTION

The present invention relates to the area of the mechanical treatment of hair, and in particular an improved straightening device intended to be used with an air blower, and in particular with a hair dryer.

STATE OF THE ART

Most devices for straightening frizzy or curly hair rely on the principle of passing the hair between grips or rollers. The majority of these devices are also provided with a heating means such as electrical resistors heating a bar or even producing hot air or steam.

A first straightening device was proposed by the inventor in the context of Document WO 03/026457. This device comprised at least three combs that formed a gripping element suitable for exerting a tension on the hair whilst at the same time heating it in order to straighten it. However, this device requires the use of a push button that positions the movable comb in line with the two other combs, allowing the insertion of hair.

Most hair straightening devices of the state of the art that are suitable for being attached to an air blower, in particular to a hot air blower such as a hair dryer or a blowing brush, are faced with the problem of air diffusion, and thus with the problem of overheating the head of the air diffuser in the sense that straightening devices generally represent an obstacle to the normal airflow upon exit from the blower. Straightening the hair is much more difficult if the airflow is impeded. The straightening mechanism that is usually used is that the hydrogen bonds in the keratin are weakened when the hair is wet, then these same bonds are re-established at different places when the hair is dried. Keratin also has disulphide bonds that are only attacked when the hair is chemically treated (ammonia). This type of treatment is however much more aggressive to the hair (perms).

The present invention intends in particular to solve the problem of straightening the hair with a geometrical design of the straightening device that leaves greater freedom to the generated airflow by positioning air-diffusion grilles on either side of two hair straightening elements.

AIMS OF THE INVENTION

The present invention aims to provide an hair straightening device that is improved compared with the state of the art, and in particular a device comprising two straightening elements positioned on either side of an air-diffuser element that allows an improved air distribution and a better control of the air temperature through the straightening device. The new device will also have to allow to stretch the hair lock above the air diffuser so as to optimally combine the mechanical straightening by pinching and the thermal straightening by the applying tension to the hair lock above the air diffuser. The attached figures allow immediate understanding of the operating mode of the device of the invention.

SUMMARY OF THE INVENTION

The present invention discloses a device for straightening hair, to placed on an air blower, comprising a first straightening element and a second straightening element positioned on either side of an air diffuser, each of both elements having an outer comb and an inner comb, removably attached to allow a sliding movement of each one relative to the other, said sliding movement of both inner or outer combs allowing to grip the hair and to stretch it above the air diffuser, the teeth of the outer combs being formed by a succession of arches whose holes define two tunnels that make space for the inner combs in such a way as to allow the arrangement of said inner combs beneath said outer combs within said tunnels and to allow said sliding movement of the inner combs relative to the outer combs in order to displace the teeth of said inner combs relative to the planes formed by the arches of the outer combs.

According to particular embodiments, the invention comprises one or several of the following features:

- the external profiles of the teeth of the inner combs are more or less equal to the holes of the arches of the outer combs, leaving a slight gap to allow the inner comb to move freely;
- the teeth of the inner combs have bevelled profiles that allow to insert the hair lock more easily;
- the teeth of the inner combs also have profiles in the form of an arch, the hole allowing the air to circulate even more;
- the pitch of the outer combs is essentially identical to that of the inner combs, without which there would be no fit between the holes of the inner and outer combs when the lock is inserted in the teeth of the combs;
- the device comprises an elastic means for maintaining the inner combs in position relative to the outer combs in order to exert some "pinching" force on the hair;
- the position-maintaining means is a spring or a pair of springs;
- the spring is provided with a means for regulating the force of said spring in order to adjust the "pinching" force exerted on the lock when it passes through the straightening combs;
- the means for regulating the force of said spring is an adjusting screw;
- the adjusting screw for the spring force is linked to the regulation of the power and/or of the airflow rate of the air blower in order to adjust the power to the difficulty of straightening the hair locks;
- the device comprises a system for detecting the presence of said device on the air blower allowing to regulate the heating power of said air blower and to take into account possible overheating due to partial interruption of the airflow by the straightening device;
- the system for detecting the presence of said device on an air blower comprises electrical detection circuits and a sensor;
- the device also comprises untangling and shining combs on either side of the first and second straightening elements;
- the air diffuser is a metal grille;
- the air blower comprises indicators for power, spring pressure and airflow rate.

BRIEF DESCRIPTION OF THE FIGURES

FIGS. 4, 5 and 6 respectively show the mechanism for inserting in the device the hair or locks to be smoothed followed by the straightening of these same locks.

DETAILED DESCRIPTION OF THE INVENTION

Figure 1:
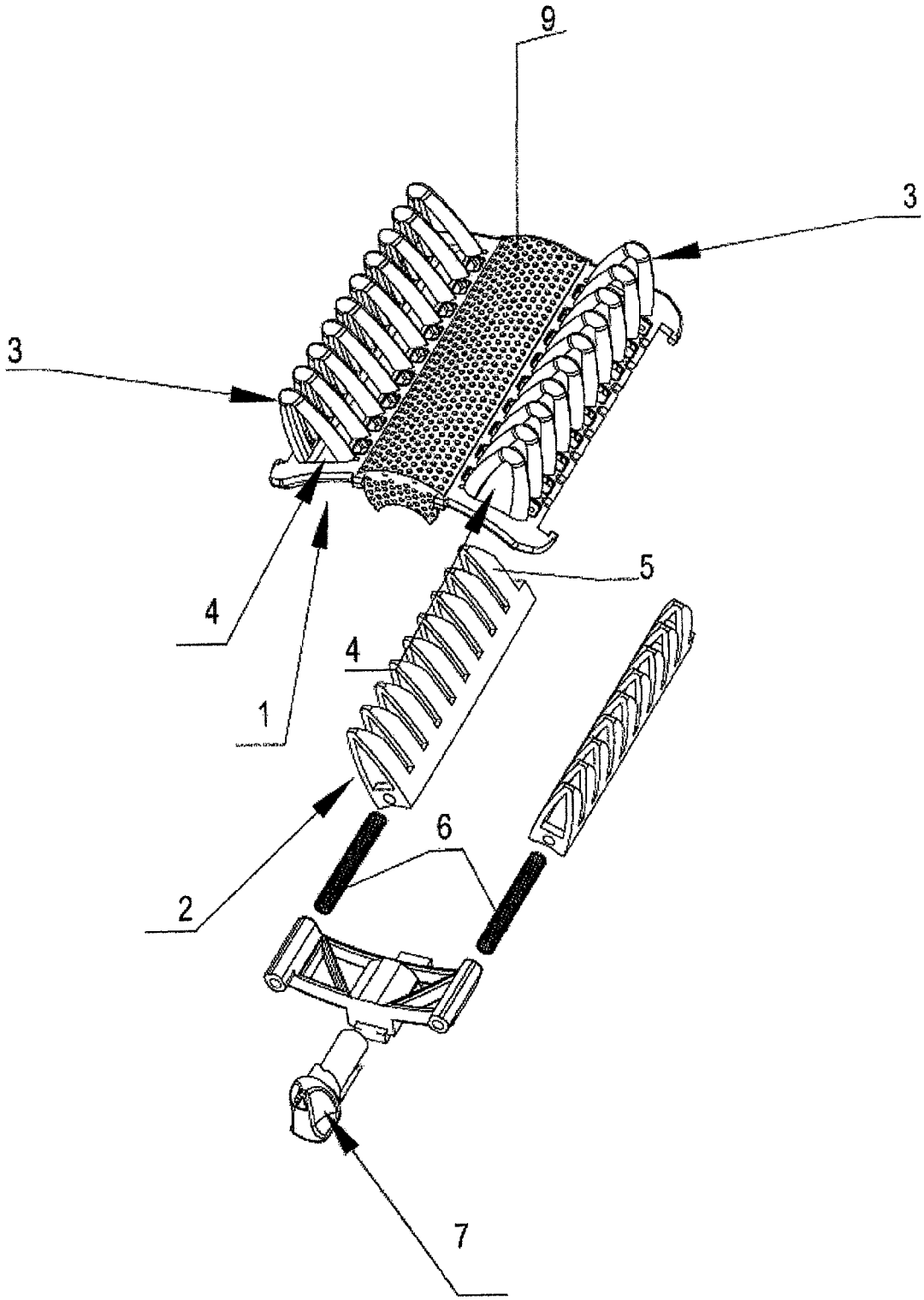
FIG. 1 shows the essential elements of the present invention, namely the first and second straightening elements positioned on either side of an air diffuser, each of the straightening elements being provided with a tunnel-shaped comb with a movable comb that can move inside this tunnel by means of a spring.

The device in the present invention may be applied to any air blower, such as for instance a specially adapted blowing brush or a traditional hair dryer.

The device of the invention comprises two straightening elements positioned on either side of an air diffuser that will be called "first straightening element" 16 and "second straightening element" 17. Each of the straightening elements 16 and 17 comprises two essential elements: these are two combs, overlapping each other, that will be called "inner comb 2" and "outer comb 1". The outer comb 1 is in the shape of a series of aligned arches 3 with a hollow part formed by the holes of the successive arches and forming a tunnel 4 in which the inner comb 2 is located, both being movably arranged relative to each other. The word "arch" is to be understood in the architectural sense according to the Larousse dictionary definition.

The inner comb 2 has a shape that is similar to the hole formed by the arches 3 of the outer comb 1. The one being movable relative to the other. The essential elements, i.e. the inner comb 2 and the outer comb 1 positioned on either side of an air diffuser (grille) of this straightening device are visible in FIG. 1 where they are separately shown so that the elements can be distinguished in detail. The inner comb 2 itself may also be hollow and thus be arch-shaped. This arch shape of the inner comb allows to further lighten the structure and to improve the diffusion of air through the straightening elements, which is an essential aim of the invention.

The outer comb 1 forming the tunnel 4 could also move relative to the inner comb 2, which may remain fixed. The important point is to generate the movement of one element relative to the other in order to grip the hair when the locks are inserted between the inner and outer combs and thus to create some pinching effect. However, the embodiment in which the outer comb is movable is not shown so that the figures are not unnecessarily complicated.

Figure 2:
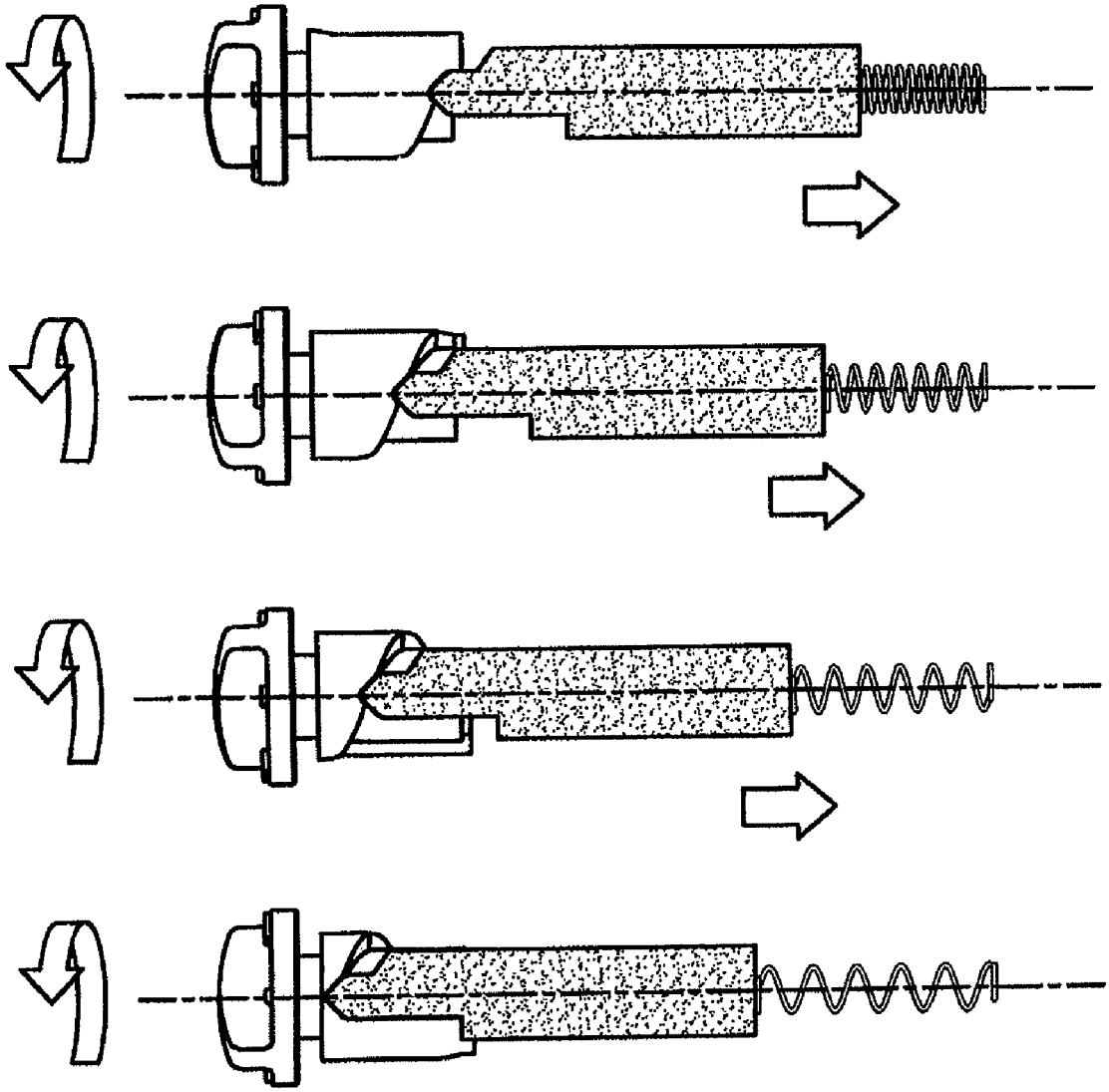
FIG. 2 shows the mechanism for regulating the spring of the movable comb.
Figure 3:
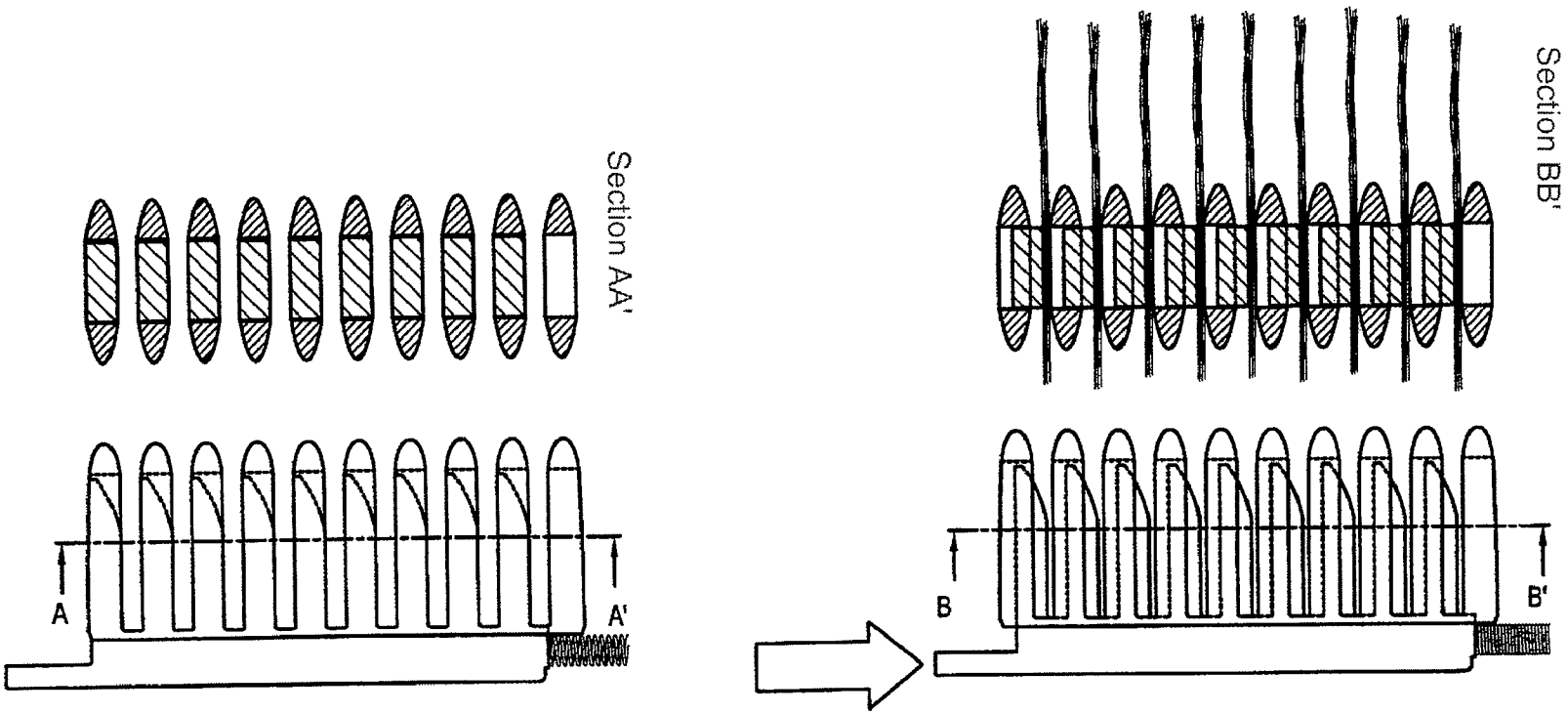
FIG. 3 shows sections A-A' and B-B' with both a top view and a side view of the tunnel comb with the movable comb moving inside the tunnel comb; the top view of section B-B' shows the straightening of the hair when the movable comb is moved in the direction of the arrow.
Figure 4:
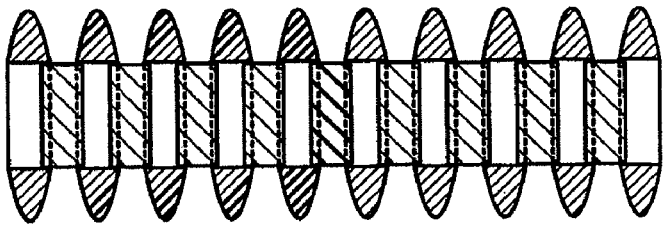
FIG. 4 shows in section A-A' the insertion of the hair locks to be smoothed in the straightening device.
Figure 4:
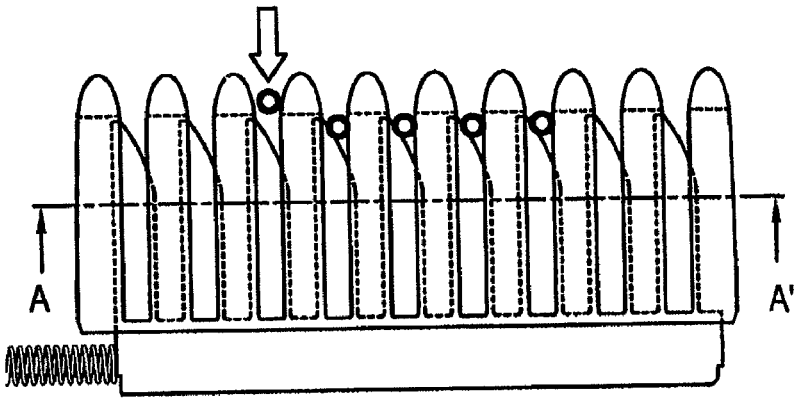
Figure 4:
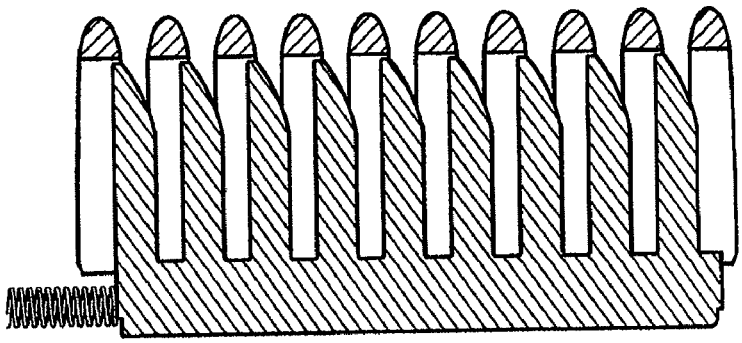
Figure 5:
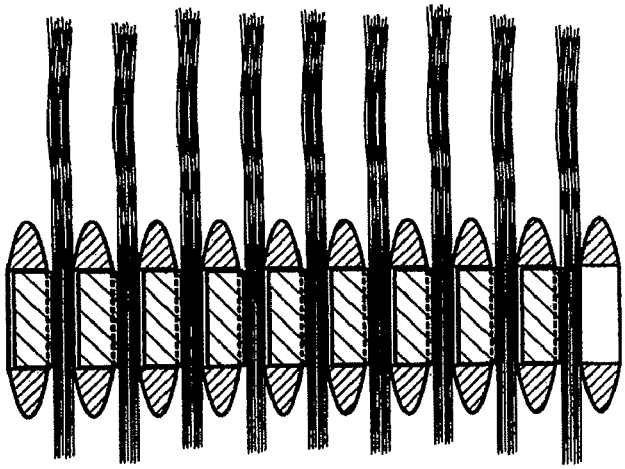
Figure 5:
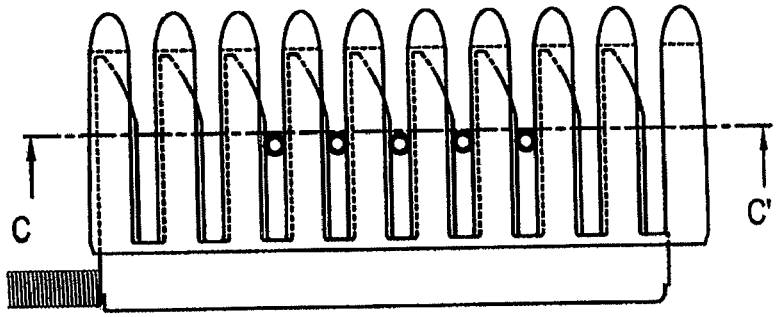
Figure 5:
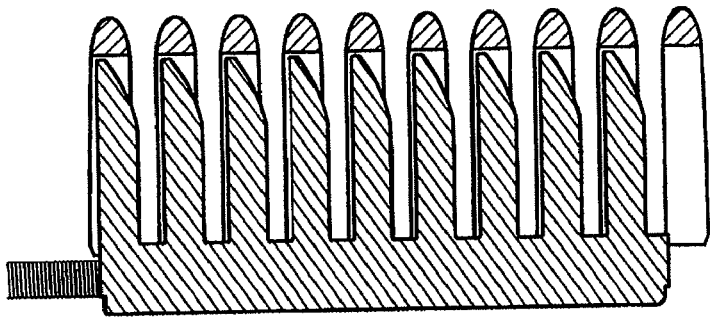
Figure 6:
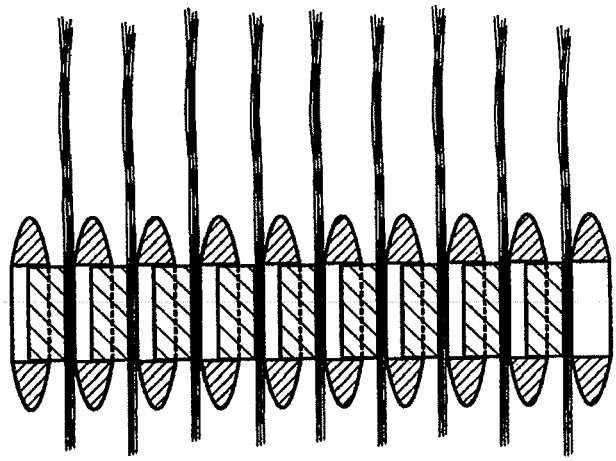
Figure 6:
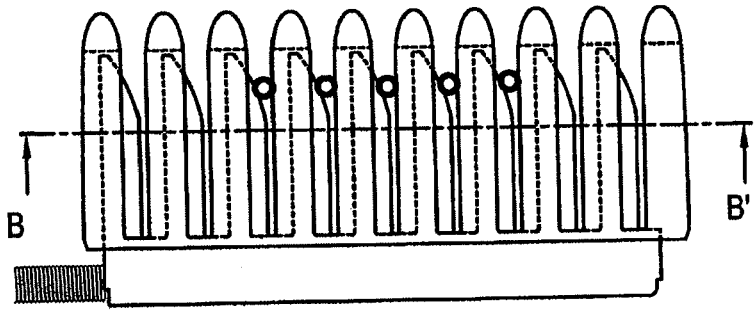
Figure 6:
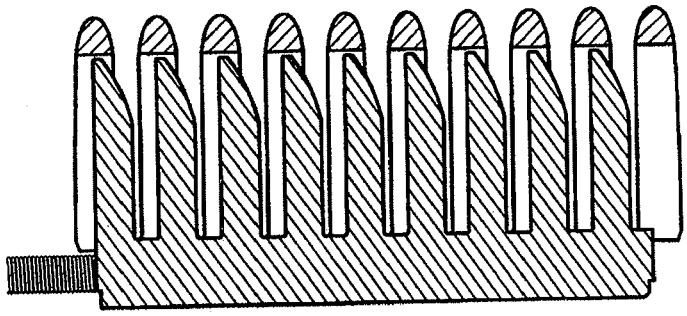

The resistance provided by the springs 6 to move the inner combs 2 relative to the outer combs 1 may be regulated by means of a screw 7 shown in FIGS. 1 & 2.

The hair straightening mechanism relies on using the device in the closed position, i.e. where the bevelled teeth 5 are misaligned relative to the plane formed by the arches 3, and on inserting the hair locks, which themselves adjust the position of the movable comb with the force provided by the spring 6 of the adjusting screw 7 being the only resistance. This force is adjustable (see FIG. 2). In other words, by pulling the hair locks through the teeth of the device, the user causes the adjustment of the teeth relative to each other as a function of the tension applied to said locks, this being so for both straightening elements 16 and 17. The resistance that both straightening elements 16 and 17 exert upon the passage of the hair lock allows to stretch it above the air diffuser 9 positioned between the two elements 16 and 17, which further improves the straightening effect.

Figure 7:
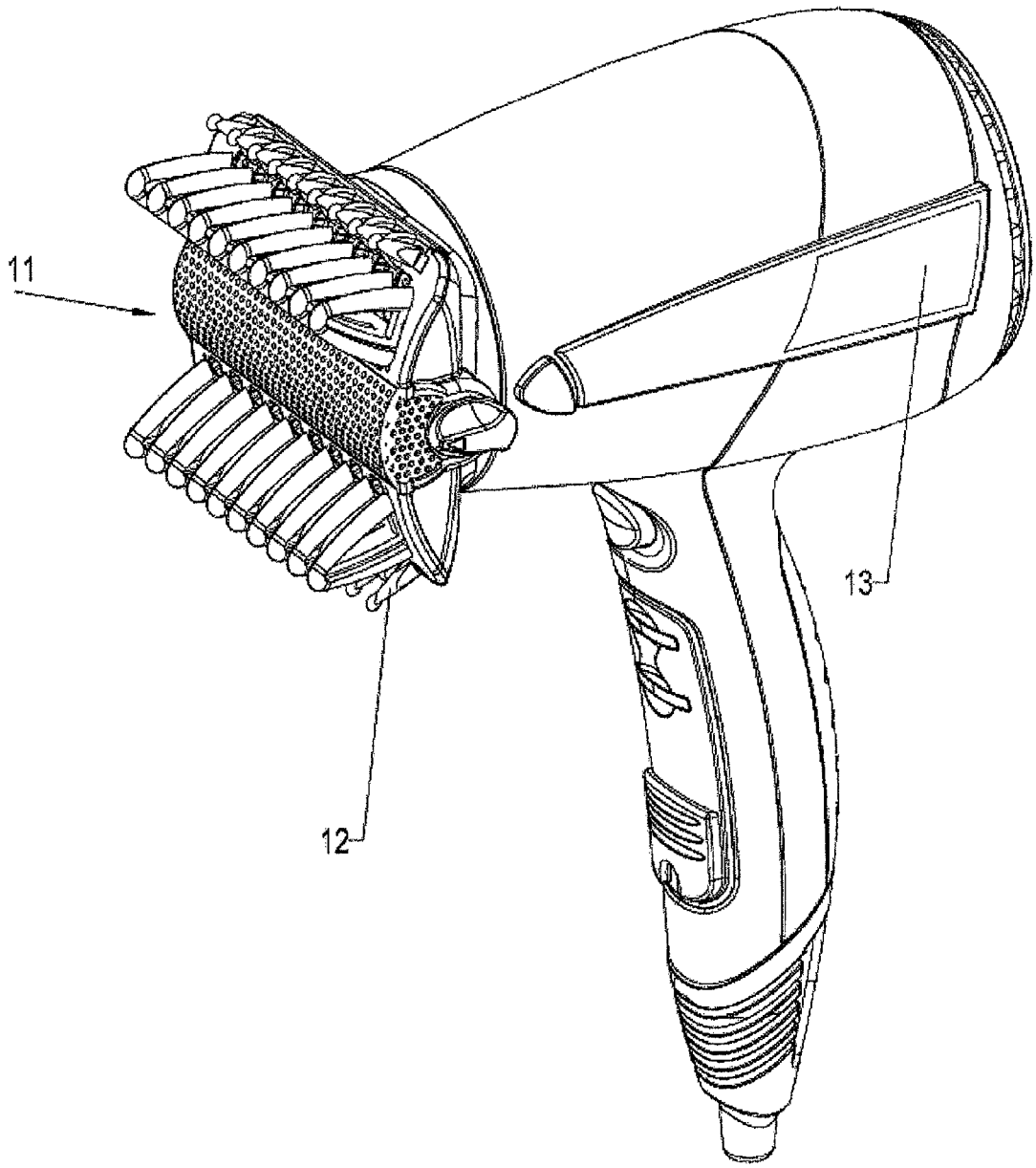
FIG. 7 shows a possible use of the device of the invention on a hair dryer.
Figure 8:
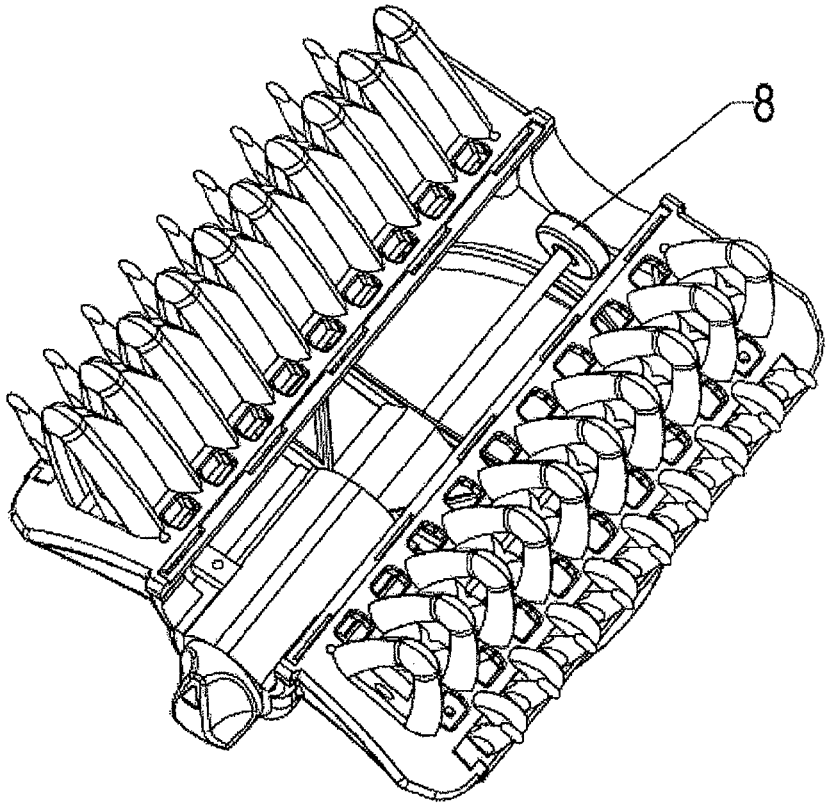
FIG. 8 shows an overview of the straightening mechanism where we tried to show the way in which a hair lock passes through the straightening device. The figure clearly shows the tension on the hair lock between the two straightening elements.
Figure 9:
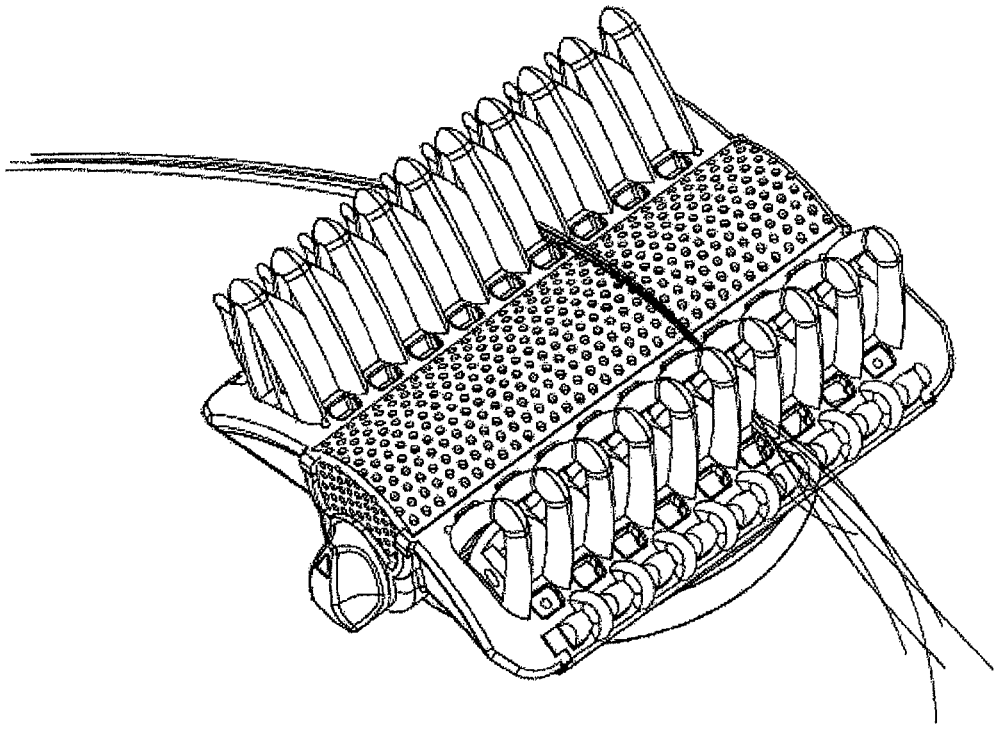
FIG. 9 shows an electronic element for preventing the overheating of the device as in the invention, incorporated into a system for regulating the heating power or the airflow rate, depending on the pressure exerted by the spring.

In normal operation, in addition to being gripped (pinched) by the two elements, the hair lock is also stretched between both straightening elements. The positioning of the air diffuser, which in some embodiments can take the form of a metal grille, thus allows the air to reach the stretched lock, further contributing to the straightening effect since it is dried in a stretched position. Thus, this provides the combined benefit of drying in a stretched position and of mechanical pinching between the inner 2 and outer 1 combs of the straightening elements. Further, embodiments of the hair straightening device can also include a untangling and shining comb 12 on each side of the first and second straightening elements as described above, and as shown at FIG. 7.

Figure 10:
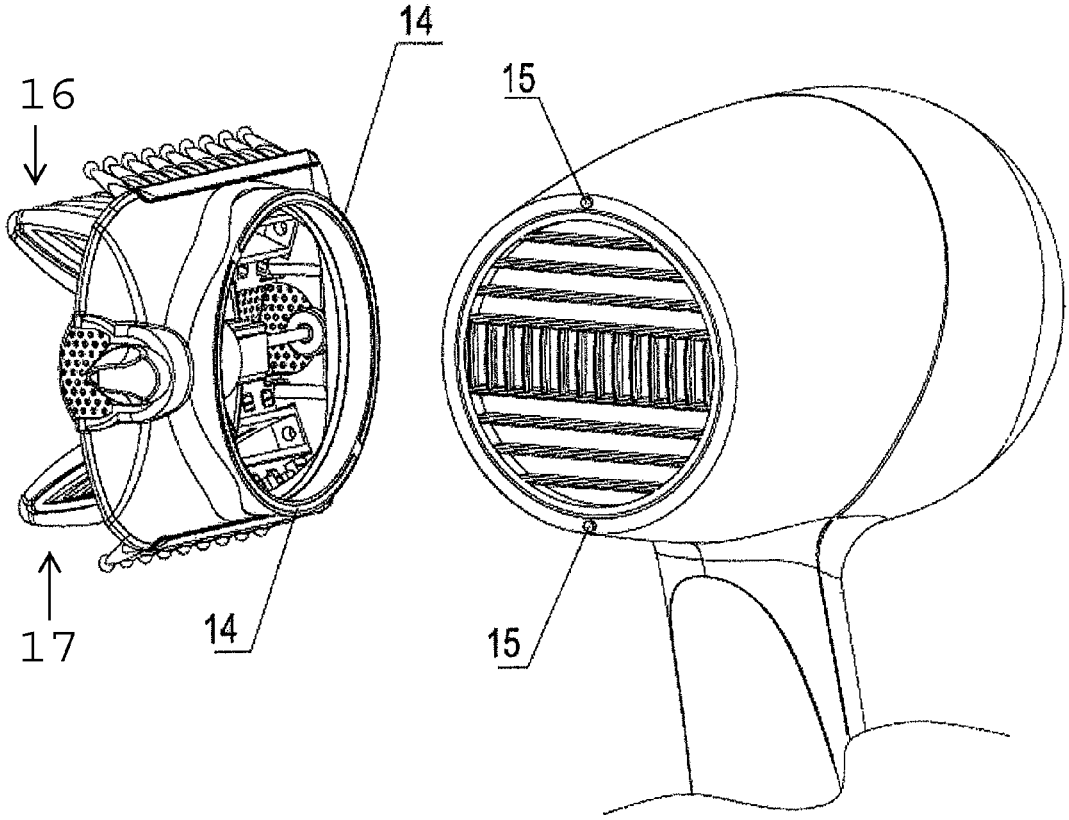
FIG. 10 shows the position of the sensors and that of the electrical circuits on the hair dryer and on the straightening device.

The present invention also tackles the temperature regulation and therefore the power of the air blower and/or the intensity of the hot air flow by incorporating in a preferred embodiment of the invention a regulation system allowing to link the power of the air blower and/or the airflow to the pressure of the spring. Further, embodiments of the present invention may also include a system for detecting the presence of the hair straightening device on the air blower and allowing to regulate the heating power of the air blower. A system for detecting the presence of the hair straightening device on the air blower can include an electrical detection circuit 14, and a sensor 15, as illustrated at FIG. 10.

It is generally acknowledged that the frizzier the hair, the higher the pressure of the spring determining the pinching force (causing the bending of the hair between the inner and outer combs) must be and the higher the heating power must be. This heating power can be regulated by adjusting the heating power of the air blower or by adjusting the airflow, or both. In order to give the user a visual control means, an indicator 13 for power/spring pressure/airflow rate may be provided on the air blower used.

The present invention therefore proposes a hair straightening device that, once placed on an air blower, becomes a true intelligent system since it automatically adapts to the user's needs.

Key

1. Outer comb
2. Inner comb
3. Arches formed by the teeth of the outer combs
4. Tunnels formed by the aligned arches of the outer comb teeth

5. Bevelled tooth of the inner comb
6. Adjustable spring
7. Adjusting screw
8. Electronic element
9. Air diffuser
Safety probe
11. Straightening device
12. Untangling and shining comb
13. Indicator for power/spring pressure/airflow rate
14. Electrical detection circuits
15. Sensor

The invention claimed is:

1. Hair straightening device to be placed on an air blower, comprising a first straightening element and a second straightening element positioned on either side of an air diffuser (9), each of both straightening elements comprising an outer comb (1) and an inner comb (2) each having a plurality of teeth, the teeth of the outer combs (1) being formed by a succession of arches (3) wherein a space is formed between adjacent arches of each of the succession of arches, the teeth of the inner comb each having an arch shaped outer periphery that is generally the same shape as the arches of the outer comb, the arches of the outer comb (1) defining a tunnel (4) that receives the inner comb (2) such that each inner comb (2) is positioned beneath the outer comb (1) and within the tunnel thereof, with each inner comb (2) slidable within the tunnel and relative to the outer comb (1) receiving the inner comb (2) to position the plurality of teeth of each inner comb (2) in said spaces of each outer comb (1), the hair straightening device further comprising a spring connected between each of the inner combs (2) and an adjustment screw, each spring biasing the teeth of the inner comb (2) into the spaces of each outer comb (1) such that each arch-shaped tooth of the inner comb biases a strand or strands of hair into contact with an adjacent arch-shaped tooth of the outer comb.

2. Device as in claim 1, wherein the pitch of the outer combs (1) is essentially identical to the pitch of the inner combs (2).

3. Device as in claim 1, also comprising an untangling and shining comb on each side of the first and second straightening elements.

4. Device as in claim 1, wherein said air diffuser (9) is a metal grille.

5. A combination, comprising:

a hair straightening device as in claim 1;

an air blower in combination with said hair strengthening device; and further comprising an electrical detection circuit (14) mounted on a mounting portion of the hair straightening, and a sensor mounted on a mounting portion of the air blower, the electrical detection circuit and sensor in electronic communication when the device is mounted on the air blower such that the air blower detects the presence of the device.

6. A combination, comprising:

a hair straightening device as in claim 1;

an air blower in combination with said hair strengthening device, and wherein the adjustment screw for the force of the spring is linked to the regulation of the power and/or of the airflow of the air blower.

* * * * *